United States Patent [19]

Gryl, Jr. et al.

[11] 4,195,201

[45] Mar. 25, 1980

[54] INDUCTIVE COIL MODULE

[75] Inventors: Frank J. Gryl, Jr.; James A. Mahler, both of East Windsor, N.J.

[73] Assignee: Western Electric Company, Incorporated, New York, N.Y.

[21] Appl. No.: 904,653

[22] Filed: May 10, 1978

[51] Int. Cl.[2] ..... H01F 17/08; H01F 15/02; H01F 15/10; H01F 27/30

[52] U.S. Cl. ..... 178/46; 174/52 PE; 336/96

[58] Field of Search ..... 178/45–46; 336/90, 96; 29/605; 333/185; 174/52 PE; 220/85 TC, DIG. 9

[56] References Cited

U.S. PATENT DOCUMENTS

| | | | |
|---|---|---|---|
| 2,047,731 | 7/1936 | Greenidge | 178/46 |
| 2,079,697 | 5/1937 | Ranges | 178/46 |
| 2,548,199 | 4/1951 | Crane et al. | 178/46 |
| 2,548,205 | 4/1951 | Drobish et al. | 178/46 |
| 2,548,206 | 4/1951 | Drom | 178/46 |
| 3,251,015 | 5/1966 | Denham | 174/52 PE X |
| 3,536,834 | 10/1970 | Dvorak et al. | 178/46 |
| 3,541,478 | 5/1970 | Peterson et al. | 333/185 X |
| 3,721,747 | 3/1973 | Renskers | 174/52 PE |
| 3,831,070 | 8/1974 | Bouille et al. | 174/52 PE X |
| 3,865,980 | 2/1975 | Moser et al. | 178/46 |
| 3,969,580 | 7/1976 | Debortoli et al. | 178/46 |
| 3,970,783 | 7/1976 | Lukas | 178/46 |

FOREIGN PATENT DOCUMENTS 366791 2/1932 United Kingdom .

OTHER PUBLICATIONS

Bulletin/Outside Application BulletinOutside Plan, Feb. 1977, AT&T: 1 page.

*Primary Examiner*—Alfred E. Smith
*Assistant Examiner*—Marvin Nussbaum
*Attorney, Agent, or Firm*—D. J. Kirk

[57] ABSTRACT

A plurality of inductive coils (FIG. 4; 10—10) are mounted in a coil module (30) which is comprised of an elongated housing (31) having a substantially oval cross section. A potting compound (44) encapsulates the mounted coils (10—10) and a layer of epoxy (46) covers the compound. Leads (11 and 12) from the coils (10—10) are attached to a pair of connectors (42 and 43) which are partially embedded in the epoxy (46) and project through an opening (32) in the housing (31).

10 Claims, 6 Drawing Figures

- PRIOR ART-

INDUCTIVE COIL MODULE

BACKGROUND OF THE INVENTION

1. Field of the Invention

This invention is related to loading coil assemblies. In particular, the invention is directed to such assemblies for use in communication transmission lines.

2. Description of the Prior Art

The loading coil has been used in the telephone communication system for over 75 years and is placed approximately every 6,000 feet in a transmission line to provide a lumped inductance to cancel the distributed capacitance in a wire pair. With hundreds of wire pairs in a transmission cable, it is necessary to store the loading coils in protective containers which can be mounted aerially, on a pole or in a manhole. A variety of containers have been designed to accommodate differing numbers of load coils. Historically, coils were mounted on wooden dowels and placed in a cylindrical container with the coil leads extending therefrom. A plurality of such containers were positioned about a transmission cable and the leads soldered to the lines to be loaded as shown in U.S. Pat. No. 2,548,199 which issued to Crane et al. on Apr. 10, 1951 and is assigned to the instant assignee.

A further improvement of such an arrangement is shown in U.S. Pat. No. 3,865,980 which issued to Moser et al. on Feb. 11, 1975 and discloses a compartmented module having a substantially semi-circular cross section. A load coil is placed in each compartment and the leads from the coils soldered to first ends of terminal elements. The terminal elements are mounted on the sides of the module where the line to be loaded is connected to a second end of the terminal element.

In recent years, cables have been fabricated with the cable wires terminated in connectors at the manufacturing location, for purposes of a quick solderless splice connection to another cable. Accordingly, it is most desirable to arrange load coil modules with mating connectors so that the coils may be inserted or removed from the transmission line without the need of having to unsolder and/or resolder a multitude of leads. One such load coil module is described in U.S. patent application No. 864,303 filed on Dec. 27, 1977 in the name of R. J. Reinebach and which is assigned to the instant assignee. That coil module has a substantially oval cross section with two rows of load coils encapsulated therein in a potting compound. Leads from the coils are soldered to smaller gauge wire which extend from the module in a pig-tail fashion. The pig-tail leads are terminated in at least one pair of male and female connectors for connection to a connectorized cable.

Such an arrangement has been found to be most effective for connecting load coils into transmission lines. However, the pig-tail arrangement is space inefficient and the soldering of the load coil wires to the smaller gauge connecting wires is time consuming and expensive.

SUMMARY OF THE INVENTION

The foregoing problems have been overcome by the instant inductive coil module comprised of a housing having a substantially oval cross section with a plurality of leaded inductive coils therein. A potting compound encapsulates the coils and a hardenable material is interposed between the surface of the potting compound and a longitudinal opening in the housing. Leads from the coils are terminated on at least one connector which is embedded in the hardenable adhesive material and a portion of which extends through the opening.

The instant module is fabricated by mounting the coils within and spaced from the sides of the housing and connecting the coil leads to terminals on a connector. The housing is then filled with a flowable potting compound, through an opening in the housing, to a level that will fully encapsulate the coils. A hardenable material is then added to fill the volume between the surface of the potting compound and the opening. The wires and the connector are embedded in the hardenable material which is then caused to become hard and hold the connector firmly in place.

Advantageously, the instant coil module permits a direct connection of the coil leads to the connector.

Further, a split-beam connector may be used which eliminates the need of soldering.

Additionally, the material, upon hardening, holds the connectors securely in place and they become an integral part of the module.

DETAILED DESCRIPTION OF THE PREFERRED EMBODIMENT

Figures 1, 2:
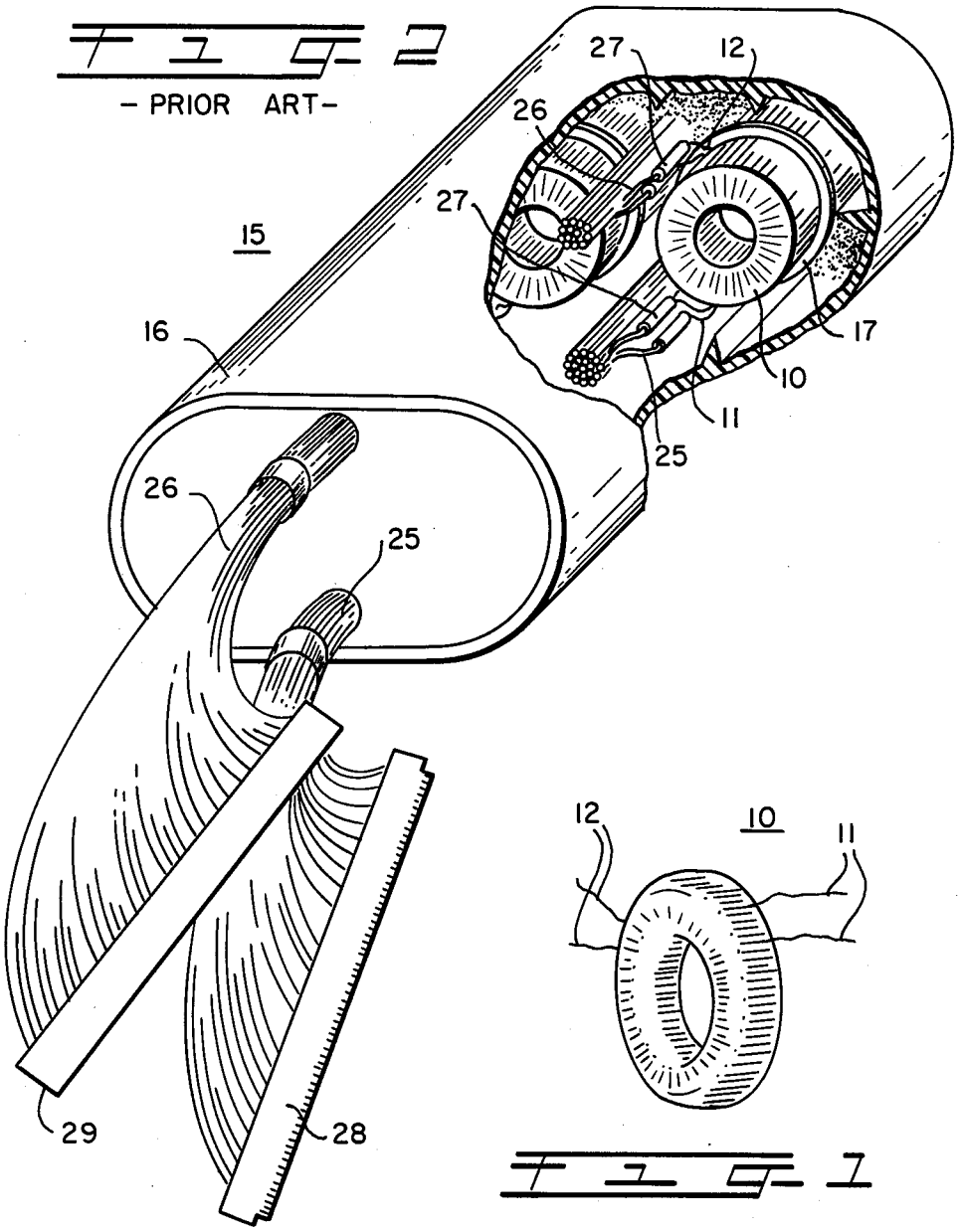
FIG. 1 depicts an inductive coil.
FIG. 2 is an isometric view of a prior art load coil module.

FIG. 1 depicts an inductive loading coil, generally designated by the numeral 10, of the type that may be used to cancel the distributed capacitance in a transmission line wire pair. The coil 10 is comprised of first and second enamel coated wires 11 and 12 which are wound about a toroidal-shaped core, not shown, which may be ferrite, iron or any other magnetic material.

A plurality of load coils 10—10 have been packaged in a coil assembly, generally designated by the numeral 15, shown in FIG. 2 and which is fully described in the above-referred to Reinebach patent. The assembly 15 is comprised of a plastic housing 16 which contains two rows of load coils 10—10, the coils being separated by epoxy coated magnetic washers 17—17 to provide electromagnetic isolation to reduce crosstalk. The first and second coil leads 11 and 12 are soldered to first and second interconnect leads 25 and 26, respectively, and plastic sleeves 27—27 placed thereon. The leads 25 and 26 exit the assembly in pig-tail fashion and are terminated on male and female connectors 28 and 29, respectively. The coil assembly 15 may be placed in larger containers or cases and mounted aerially on a pole or underground for connection to a cable to introduce the coils 10—10 into the transmission lines.

Figure 3:
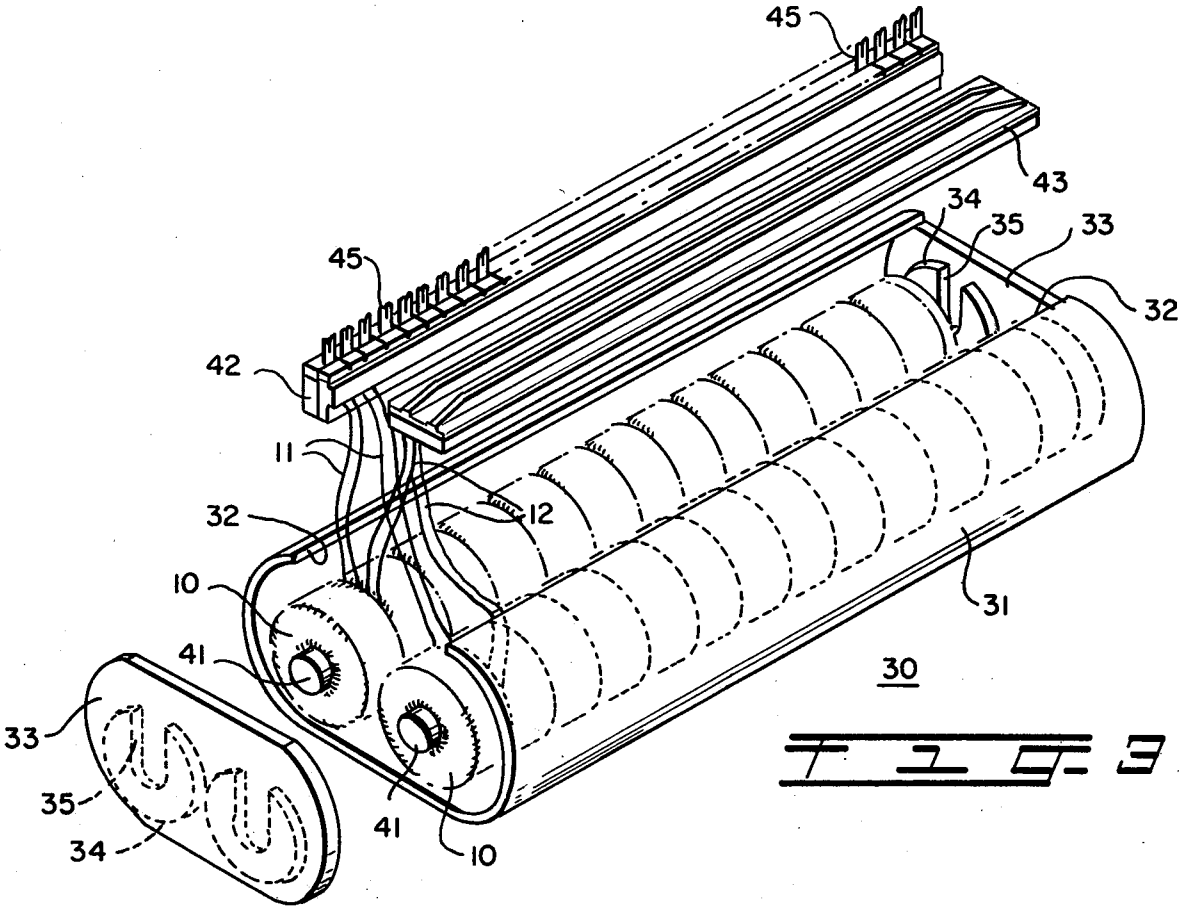
FIG. 3 is an isometric view of a coil module embodying the instant inventive concepts.

FIG. 3 shows a partially exploded view of an exemplary embodiment of the instant improved coil module which is generally designated by the numeral 30. The module 30 is comprised of an elongated hollow housing 31 having a substantially oval cross section with a longitudinal opening 32 therein. End walls 33—33, which may be adhesively joined to the housing 31, have a plurality of brackets 34—34 fixedly mounted thereon, each bracket having a radial slot 35 therein. A plurality of coils 10—10 are mounted on rods 41—41 which extend between the brackets 34-34, and are seated in slots 35-35, to hold the coils in spaced relation to the housing 31. The rods 41—41 preferably are non-conducting and may be made of wood, plastic, fiberglass or the like. Epoxy coated washers (not shown) may be placed between the coils 10—10 as shown in FIG. 2.

Figure 4:
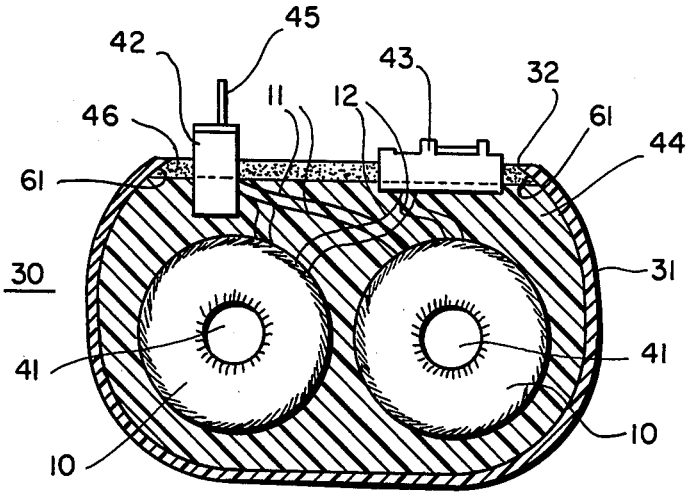
FIG. 4 is a cross-sectional view of the instant coil module.
Figure 5:
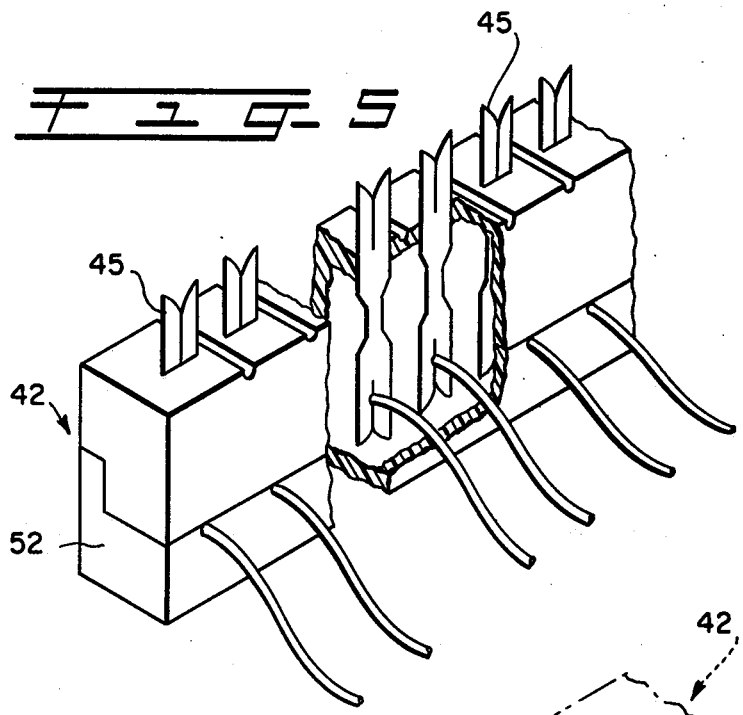
FIGS. 5 and 6 are partial sectional views of connectors used to implement the instant invention.

The first and second wires 11 and 12 are connected to a male and female connector 42 and 43, respectively, having double-ended slotted beam connector elements 45—45 which can best be seen in FIGS. 5 and 6 and will be hereinafter described in detail. The coils 10—10 are encapsulated in a potting compound (e.g., polyurethane or the like) 44, as shown in the cross-sectional view of the module 30 in FIG. 4. The potting compound 44 flows into the space between the coils 10—10 and the housing 31 and fills the housing 31 to a level that covers all the coils to provide a moisture seal. A hardenable material 46, such as epoxy, is used to fill the volume between the surface of potting compound 44 and the longitudinal opening 32. The connectors 42 and 43 are embedded in the hardenable adhesive material 46 which is then cured or otherwise hardened to firmly entrench the connectors therein. The connectors 42 and 43 need not necessarily extend through the layer of material 46 into the potting compound 44 as shown in FIG. 4. However, by so doing, the wires 11 and 12 are in full contact with the potting compound 44 which has been found to provide an excellent mechanical bond. The thickness of the layer of the material 46 need only be sufficient to securely hold the connectors 42 and 43 in place. Such thickness will depend on the size, weight, geometric configuration, etc. of the connectors 42 and 43 used.

The instant coil module 30, having a layer of the hardenable material 46 in which connectors 43 and 44 are embedded, provides a compact, simple arrangement for quickly connecting or disconnecting a plurality of coils 10—10 to a transmission cable or other electrical circuitry. The connectors 42 and 43 become an integral part of the module 30 which eliminates pig-tail leads and provide solderless connection of the wires 11 and 12 from the coils 10—10.

Although the preferred embodiment of the instant invention depicts two rows of coils 10—10 in the module 30, it should be clear to one skilled in the art that one or more rows may be accommodated by the case 31 by changing the transverse diameter of the case and embedding the appropriate number of connectors in the material 46 to accommodate the wires 11 and 12.

The particular type of connector 42 or 43 to be used is a matter of choice; any double-ended connector or terminal strip that can provide a termination for the wires 11 and 12 and can be further connected to a wire or cable may be used. Although solder or wire wrap terminals may be used, it should be apparent that solderless connectors, as shown in FIGS. 5 and 6, are most advantageous. The particular type of connector used in the exemplary embodiment is described in U.S. Pat. No. 3,858,158 to Henn et al. which is assigned to the instant assignee. The male connector 42 has a plurality of spaced, vertically arranged parallel terminals 45—45 having slots 51—51 therein. The enamel insulative coating (not shown) is removed from the ends of the leads 11—11 by scraping, electric discharge machining, solvent or other removal methods. The uncoated ends of leads 11—11 are then inserted in the lower slots 51—51 and a first cap 52 is placed thereover. The female connector 43 also has a plurality of spaced terminals 45—45 which are horizontally arranged. The enamel insulative coating is also removed from the ends of leads 12—12 which are then inserted into the slots 51, as shown in FIG. 6 and a second cap 53 placed thereon. Once the connections between the leads 11—11 and 12—12 to connectors 42 and 43 have been accomplished, the connectors are embedded in the hardenable adhesive material 46 as shown in FIG. 4.

Figure 6:
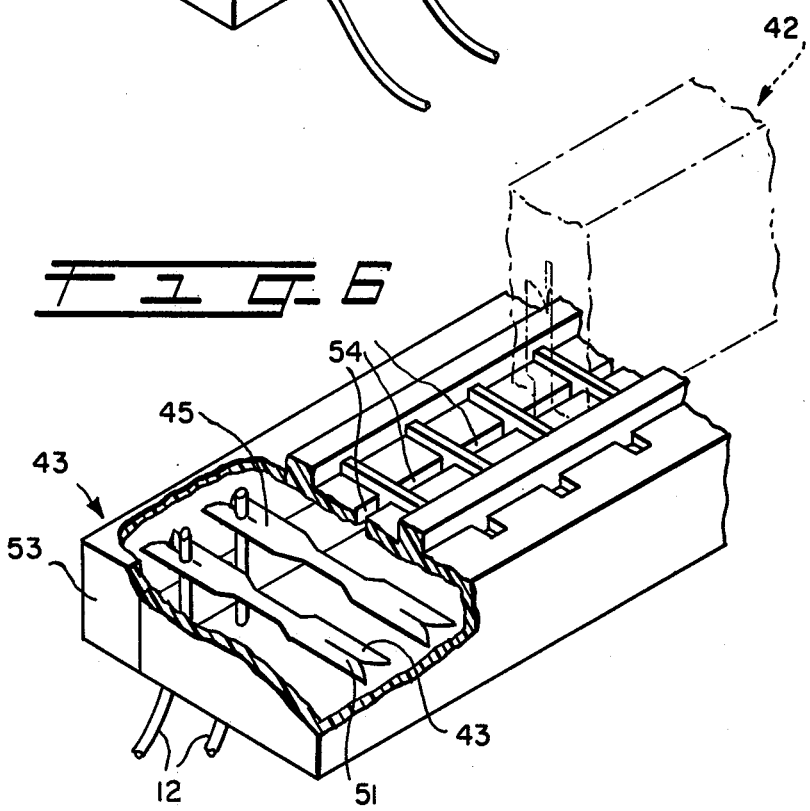

In connecting the module 30 to a cable having male and female connectors 42 and 43, the terminals 45—45 on the male connector are urged into a plurality of openings 54—54 in the female connector and a waist section 56 of the terminal is captured within the slots 51—51 as is indicated in phantom in FIG. 6.

It should be noted that a pair of male and female connectors 42 and 43 have been described in the exemplary embodiment in order to facilitate connection to the ends of two cables, one having a male connector and the other having a female connector thereon. It should be clear that a pair of connectors 42—42 could be used in the coil module and the ends of the wires of an unconnectorized cable individually inserted in the slotted elements 45—45.

The oval cross section of the instant module, which can best be seen in FIG. 4, provides an important function. Once the potting compound 44 has filled the housing 31 to the level shown (i.e., intermediate the top of the coils 10—10 and the opening 32), an overhang 61 remains above the surface of the compound. Once the layer of adhesive material 46 is hardened, it is securely held in place or anchored by the overhang 61. Other housings 31 which do not have such an overhang 61 may require grooves or projections in the side walls thereof to hold the material when the bond between the material and the compound 44 is weak.

What is claimed is:

1. A coil module, comprising:

a housing having a substantially oval cross section and a plurality of leaded inductive coils therein;

a potting compound encapsulating the coils;

a portion of the housing overhanging the potting compound;

a hardened material, covering the potting compound, captured between the overhang and the potting compound; and at least one connector embedded in the hardened material with a portion thereof accessible through an opening in the housing.

2. The coil module as set forth in claim 1 which is further characterized in that:

the connector has a plurality of terminals therein having first and second ends;

the first ends of the terminals are embedded in the hardened material and are connected to the coil leads; and the second ends of the terminals are accessible for connection through the opening.

3. The coil module as set forth in claim 1 wherein:

the hardened material is epoxy.

4. The coil module as set forth in claim 1 wherein:

the potting compound is polyurethane.

5. The coil module as set forth in claim 1, wherein:

a portion of the embedded connector extends into the potting compound.

6. A load coil module comprised of:

an elongated housing having closed ends and a substantially oval cross section;

two rows of leaded load coils mounted within and in spaced relation to the housing;

the housing having a longitudinal opening therein;

a polyurethane potting compound surrounding the load coils;

a layer of hardened epoxy interposed between the potting compound and the longitudinal opening; and a male and female connector embedded in the epoxy layer, with a portion of each connector protruding through the longitudinal opening.

7. A method of fabricating a coil module comprising a housing having a plurality of leaded coils therein, the method comprising the steps of:

connecting the coil leads to terminals on a connector;

p1 filling the housing with a flowable potting compound, through an opening in the housing, to a level that fully encapsulates the coils;

adding a hardenable material to fill the volume between the surface of the potting compound and the opening;

embedding the connector and wires in the hardenable material; and capturing the hardenable material between an overhanging portion of the housing and the potting compound as the compound and the materials are hardened.

8. The method of fabricating a coil module as set forth in claim 7, wherein:

the potting compound is polyurethane.

9. The method of fabricating a coil module as set forth in claim 7, wherein:

the hardenable material is epoxy.

10. The method of fabricating a coil module as set forth in claim 7, which is further characterized in that:

causing a portion of the embedded connector to extend into the potting compound.

* * * * *

UNITED STATES PATENT OFFICE

CERTIFICATE OF CORRECTION

PATENT NO. : 4,195,201

DATED : March 25, 1980

INVENTOR(S) : Frank J. Gryl, Jr.; James A. Mahler

It is certified that error appears in the above-identified patent and that said Letters Patent are hereby corrected as shown below:

In the title page under OTHER PUBLICATIONS "Bulletin/Outside Application BulletinOutside Plan," should read --Product Application Bulletin/Outside Plan,--.

In the claims Column 5, claim 7, line 16, "pl filling" should read --filling--. Column 6, claim 7, line 8, "materials" should read --material--.

Signed and Sealed this

*Fifteenth* Day of *July 1980*

[SEAL]

*Attest:*

SIDNEY A. DIAMOND

*Attesting Officer*

*Commissioner of Patents and Trademarks*